US008191544B2

(12) United States Patent
Buck

(10) Patent No.: US 8,191,544 B2
(45) Date of Patent: Jun. 5, 2012

(54) PEEPSIGHT FOR ARCHERY

(76) Inventor: John P Buck, Douglassville, PA (US)

( * ) Notice: Subject to any disclaimer, the term of this patent is extended or adjusted under 35 U.S.C. 154(b) by 288 days.

(21) Appl. No.: 12/773,492

(22) Filed: May 4, 2010

(65) Prior Publication Data

US 2011/0271942 A1 Nov. 10, 2011

(51) Int. Cl.
*F41G 1/467* (2006.01)

(52) U.S. Cl. ..... 124/87; 33/265; 124/90

(58) Field of Classification Search ..... 33/265; 124/87, 90, 91, 92
See application file for complete search history.

(56) References Cited

U.S. PATENT DOCUMENTS 3,703,770 A * 11/1972 Sofield ..... 33/265
4,011,853 A 3/1977 Fletcher
4,454,857 A 6/1984 Miller
4,656,747 A 4/1987 Troncoso
4,860,458 A 8/1989 Ernstsen
5,347,976 A 9/1994 Saunders
5,379,747 A 1/1995 Morris
5,379,748 A 1/1995 Carlson
5,542,186 A * 8/1996 Saunders ..... 33/265
5,860,408 A 1/1999 Summers
7,040,027 B1 5/2006 Shaffer et al.
7,266,896 B1 9/2007 White
7,373,723 B1 5/2008 Topper, Jr.
7,543,390 B2 6/2009 Bach

* cited by examiner

*Primary Examiner* — John Ricci
(74) *Attorney, Agent, or Firm* — Howson & Howson LLP

(57) ABSTRACT

A unitary, bow string-supported, peepsight for archery comprises a solid block having a central sighting opening. The bow string, which is aligned with the center of the sight opening extends through a slot in the block, the slot comprising first and second slot portions in a first face of the block, and a third slot portion in an opposite face of the block, the third slot portion being between the first and second slot portions with reference to the length of the slot. Tension in the string causes the string to tighten against the slot walls, thereby firmly securing the block to the string.

4 Claims, 3 Drawing Sheets

PEEPSIGHT FOR ARCHERY

FIELD OF THE INVENTION

This invention relates to archery, and more particularly to a peepsight capable of being mounted on a bow string in order to improve accuracy by minimizing aiming errors due to parallax and inconsistent elevation.

BACKGROUND OF THE INVENTION

String-mounted peepsights for archery are described in various United States patents, among them being the following:

U.S. Pat. No. 4,011,853 Fletcher
U.S. Pat. No. 4,454,857 Miller et al.
U.S. Pat. No. 4,656,747 Troncoso
U.S. Pat. No. 4,860,458 Ernsten
U.S. Pat. No. 5,347,976 Saunders
U.S. Pat. No. 5,397,747 Morris et al.
U.S. Pat. No. 5,379,748 Carlson
U.S. Pat. No. 5,860,408 Summers
U.S. Pat. No. 7,040,027 Shaffer et al.
U.S. Pat. No. 7,266,896 White
U.S. Pat. No. 7,373,723 Topper, Jr.
U.S. Pat. No. 7,543,390 Bach A number of these sights, exemplified by the sight described in Saunders U.S. Pat. No. 5,542,186, are mounted between parts of a longitudinally split bow string so that the sight opening can be aligned with the unsplit parts of the bow string. Other sights, exemplified by the sight described in Troncoso U.S. Pat. No. 4,656,747, and Summers U.S. Pat. No. 5,860,408, provide a path by which a bow string is diverted around a sight opening so that the opening can be aligned with the bow string. The latter devices are composed of multiple parts.

A peepsight that is composed of a single, unitary part has the advantages that it can be manufactured easily and inexpensively, and that it is securely held in place when installed on a bow string, but can be installed on, and removed from, a bow string quickly and easily.

SUMMARY OF THE INVENTION

The peepsight according to the invention is a unitary, i.e., one-piece, element having a string-receiving slot configured so that it can receive a bow string when the string is in a slack condition, but can firmly secure the sight to the bow string when the string is in tension.

The peepsight comprises a unitary block of substantially rigid solid material having an upper end, a lower end, a front face and a rear face. A sighting opening extends through the block from the front face to the rear face at a location spaced from, and between, the upper end and lower ends. An upper bow string opening is provided in the upper end and a lower bow string opening is provided in the lower end. The sighting opening has a center aligned with the bow string openings along a first direction.

A slot extends from the upper bow string opening to the lower bow string opening, and extends around the sighting opening. The slot has an opening to the exterior of the block along its entire length so that a bow string can be introduced, into the slot when the bow string is in a slack condition. The slot has internal surfaces that are engageable by a bow string extending through the slot and in tension. These internal surfaces include a first surface, a second surface, and a third surface between said first and second surfaces with reference to the length of the slot. The first and second surfaces face in directions opposite to the direction in which the third surface faces, whereby engagement of a bow string with the first, second and third surfaces when the bow string is in tension prevents disengagement of the block from the bow string.

In a preferred embodiment of the peepsight, the first surface of the slot is in a first portion of the slot formed in the front face of the block, and extends from the upper end of the block to a first intermediate location between the upper and lower ends. The second surface of the slot is in a second portion of the slot and is also formed in the front face of the block. The second portion extends from the lower end of the block to a second intermediate location between the upper and lower ends. These first and second portions are both connected, respectively at the first and second intermediate locations, to a third portion of the slot formed in the rear face of the block. The third surface is in the third portion of the slot.

As will appear in the detailed description to follow, tension applied to the bow string pulls the string tightly against the first, second and third surfaces of the slot, thereby securing the block firmly to the bow string.

Further objects and advantages of the invention will be apparent from the following description when read in conjunction with the drawings.

DETAILED DESCRIPTION OF THE PREFERRED EMBODIMENTS

The peepsight of the invention is formed from a unitary block of solid material, preferably a metal such as aluminum, or a polymer such as a polyamide (Nylon), acrylonitrile butadiene styrene (ABS) or the like. The peepsight can be cast in a mold, or formed by CNC machining using computer-controlled milling cutters.

The peepsight is designed so that it can be readily attached to a bow string when the string is brought to a slack condition using a bow press, and so that it is securely held on the bow string by friction when the string is in tension.

Figure 2:
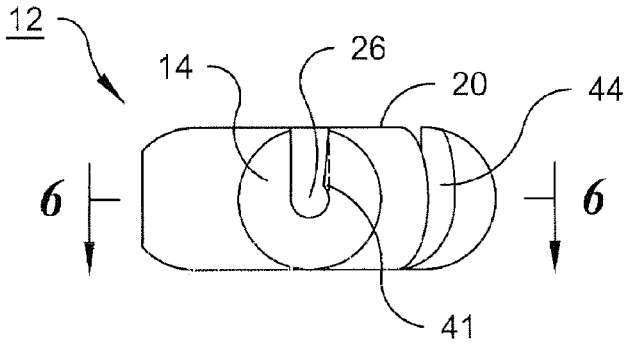
FIG. 2 is a top plan view.
Figure 1:
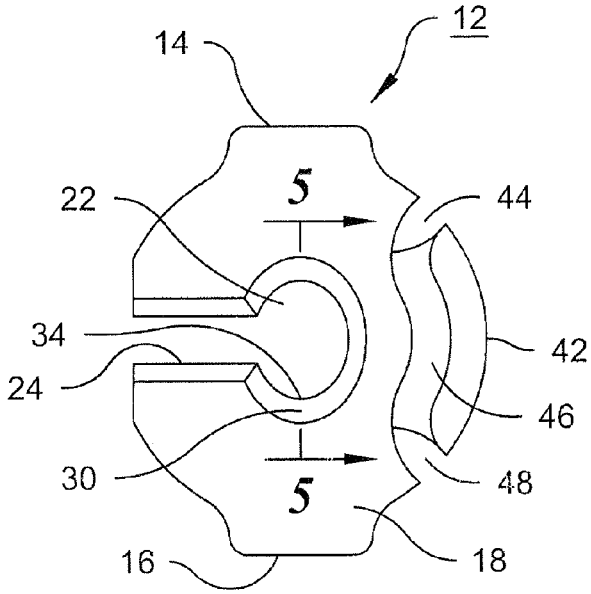
FIG. 1 is a front elevational view of a peepsight in accordance with the invention.
Figure 3:
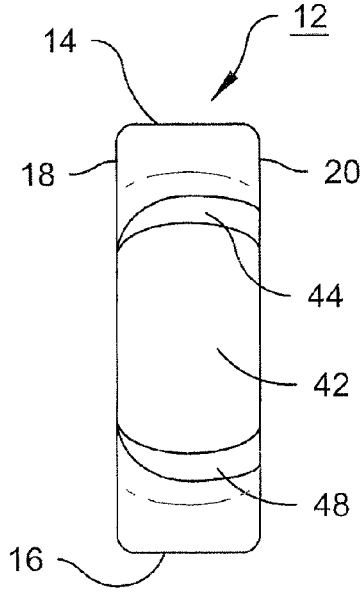
FIG. 3 is a right side elevational view.

As shown in FIGS. 1-3, the peepsight 12 has an upper end 14, a lower end 16, a front face 18 and a rear face 20, An opening 22 extends through the block from the front face 18 to the rear face 20 at a location spaced from, and between, the upper and lower ends. Preferably the opening is located midway between the upper and lower ends.

Figure 5:
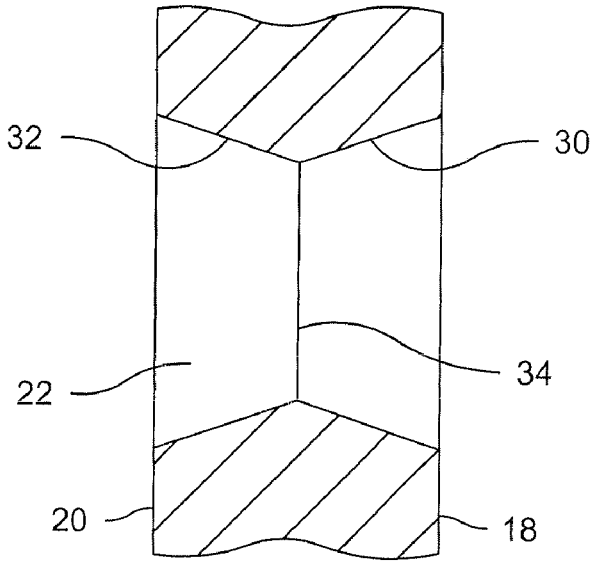
FIG. 5 is a fragmentary cross-sectional view taken on section plane 5-5 in FIG. 1, showing the sighting hole.
Figure 4:
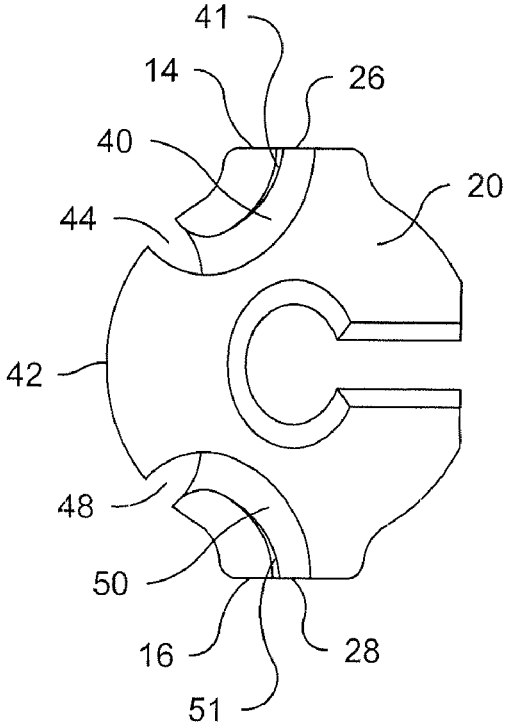
FIG. 4 is a rear elevational view
Figure 6:
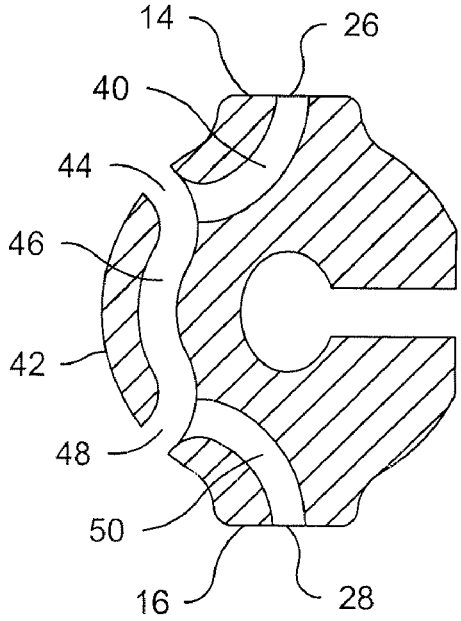
FIG. 6 is a cross-sectional view taken on surface 6-6 in FIG. 2.

The opening 22 is used for sighting. Its vertical cross-sections are in the shape of ellipses having a slight vertical elongation. As shown in FIG. 5, the sighting hole is doubly tapered, having two frusto-conical walls 30 and 32, having their widest parts respectively in its front and rear faces 18 and 20, and their narrowest parts in a common plane midway between, and parallel to, faces 18 and 20. The narrowest part of the opening 22 is defined by a part 34 of an ellipse, the long axis of which is aligned with upper and lower bow string openings 26 (FIGS. 2, 4 and 6) and 28 (FIGS. 4 and 6). The sight is mounted on the bow string a short distance above the mid-point of the string. Because the opening has an elliptical shape, the aperture appears circular, or nearly circular, when the string is drawn back and therefore disposed at an angle relative to the vertical. The eccentricity of the ellipse should correspond to the usual deviation of the bowstring from vertical when drawn back. That is, the ratio of the short dimension of the ellipse to its long dimension should be approximately equal of the cosine of the angle between the upper part of the bow string and an imaginary vertical line when the string is drawn back.

A slot 24 extends from the left side of the peepsight to the opening 22 to enable the user to maintain a constant view of the target while aiming. This slot is especially useful under dimly lit conditions, when even a momentary interruption of the view of the target by a part of the peepsight can cause the target to be lost. If the user prefers to move the bow from right to left when aiming, the peepsight can be installed on the bow string with its front face 18 toward the user and its rear face 20 toward the target, in which case, continuous sight of the target can be maintained. Alternatively, if the user prefers to move the bow from left to right when aiming, the block can be installed either upside-down, or with its front face 18 toward the target and its rear face 20 toward the user. Slot 24 can have a double taper corresponding to that of sighting hole 23 to minimize the decrease in the apparent vertical dimension of its aperture as the bow string is drawn back.

As seen in FIGS. 2, 4 and 6, the upper bow string opening 26 is provided in the upper end 14 of the block. FIGS. 4 and 6 show a similar opening 28 in the lower end 16 of the block.

When the block is installed on a bow string, the bow string extends around the sighting opening 22 on the side thereof opposite from the side in which slot 24 is located. Consequently, no part of the bow string extends across the slot, and full advantage can be taken of the ability of the slot to allow uninterrupted acquisition of a target.

The portion of the bow string that is engaged with the block is situated in a bow string-receiving slot that extends from the upper bow string opening 26 to the lower bow string opening 28. The bow string-receiving slot preferably includes five parts. The first part is a curved slot part 40 (FIG. 4) in rear face 20, which extends from the upper bow string opening 26 to the right side 42 of the block (left side in FIG. 4). The second part is a slot part 44 (FIGS. 1-4), which extends across the right side 42 of the block from the rear face 20 to the front face 18. The third part is a slot part 46 (FIG. 1), which is disposed in the front face 18, and extends generally vertically past the sight opening. A fourth part is slot part 48 (FIGS. 1, 3, 4 and 6), which extends from the lower part of slot part 46, across right side 42, to the rear face 20. Part 48 is identical to part 44. The fifth part is slot part 50 in the rear face 20. Part 50, which is identical to part 40, extends from part 48 to the lower bow string opening 28, as shown in FIG. 4. The continuity of the slot parts is illustrated in FIG. 6, which is a sectional view. Slot part 40 is undercut as shown in FIGS. 2 and 4. Slot part 40 includes a protrusion 41 shaped so that the entrance to the slot part in rear wall 20 is tapered slightly, at least near upper opening 26. The taper allows the bow string to be inserted into the slot easily. As shown in FIG. 2, the slot is undercut so that its inner part beyond protrusion 41 widens. Slot part 50 has an identical configuration. The undercut configuration of slot parts 40 and 50 ensures that protruding parts of the block are disposed between parts of the inner surfaces of slot parts 40 and 50 and the rear face 20 of the block. By virtue of the protruding parts, concave surfaces are presented to the bow string at the locations in slot parts 40 and 50 where the maximum force is exerted by the bow string on the slot wall. Consequently, the bow string cannot easily be removed from the block as a result of twisting of the block when the bow string is under tension.

Slot part 46 can have a compound curvature as seen in FIGS. 1 and 9 so that the wall between slot 46 and the sight opening 22 can be sufficiently thick to maintain adequate strength, while the channel in which the bow string is situated is bent sufficiently to prevent the block from sliding on the bow string when the bow string is in tension.

Figure 7:
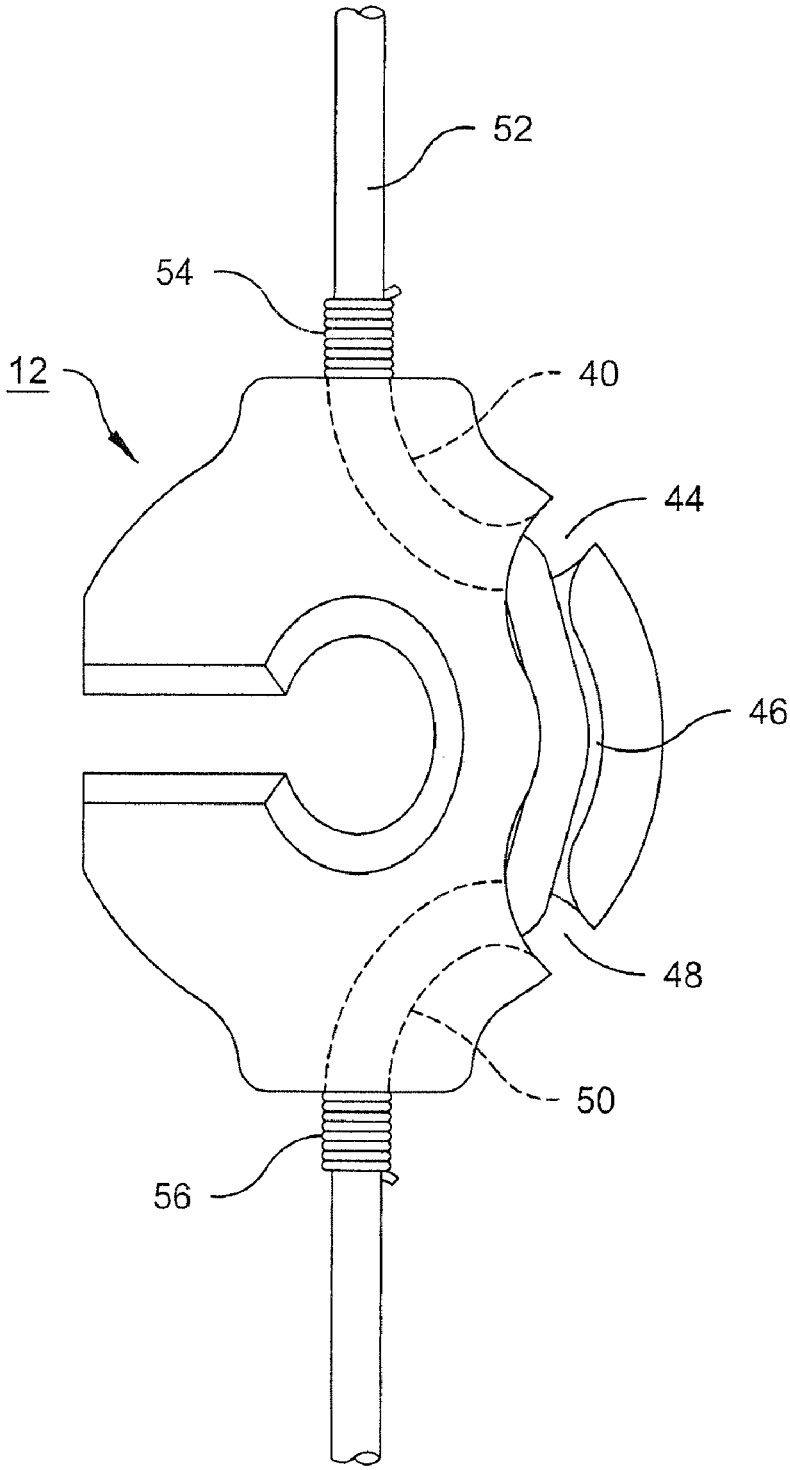
FIG. 7 is a front elevational view showing the peepsight secured to a bow string.

As shown in FIG. 10, a bow string 52 extends through slot parts 40, 44, 46, 48 and 50. The leftward facing walls of slot parts 40 and 50, as shown in broken lines in FIG. 7 and the rightward facing wall of slot part 46, face in opposite directions. Since slot part 46 is disposed between slot parts 40 and 50 along the length of the slot, and walls of slot parts 40 and 50 face toward the left while a wall of slot part 46 faces toward the right, tension in the bow string causes the string to press against these oppositely facing walls, and prevents disengagement of the peepsight from the bow string. The bow string can be served at 54 and 56 for further assurance against sliding of the block along the bow string.

The peepsight according to the invention has a number of advantages over known string-mounted peepsights. Because of its one-piece construction, it can be manufactured inexpensively, by molding or automated machining. The avoidance of multiple parts and fasteners also makes the peepsight easy to install and remove, and provides for improved durability.

In the embodiment shown, the bow string-receiving slot is configured so that the centerline of the parts of the bow string situated in the slot is in, or very nearly in, a common plane with the parts of the string that extend from the upper and lower openings 26 and 28. In this embodiment, the oppositely facing surfaces of the slot that are tightly engaged by the bow string due to tension face in directions parallel, or nearly parallel, to the front and rear faces 18 and 20 of the block. It is not necessary, however, for the centerline of the bow string to be situated in a plane. If slot part 46 is shallower, for example, the string will be bent forward within slot portion 44 and rearward within slot portion 48, and the forces exerted by the slot walls on the string can include forward components in slot part 46 and rearward components in slot parts 40 and 50. As another alternative, the intermediate slot part corresponding to slot part 46 can be open to the right side of the block instead of toward the front of the block.

The sight is preferably symmetrical about a central horizontal plane, and the sighting hole 22 and slot 24 are preferably symmetrical about a central vertical plane in which the narrowest part 34 of opening 22 (FIG. 5) is situated. With these symmetries, the sight can be installed with slot 24 opening to the left or to the right, and can be installed upside down without affecting the performance of the sight. Although the sight is preferably symmetrical, many of the advantages of the sight can be realized in various asymmetric versions. For example, the upper and lower slot parts 40 and 50 do not need to be identical in shape. As another example, the sighting hole can be made asymmetric so that the conical part of the opening facing the user has an apparent uniform width when the bow string is drawn back.

Many other modifications, in materials, shape, and slot configuration, and modifications in other respects, can be made to the peepsight described herein without departing from the scope of the invention as defined by the following claims.

What is claimed is:

1. A peepsight comprising a unitary block of substantially rigid solid material having an upper end, a lower end, a front face and a rear face, a sighting opening extending through the block from the front face to the rear face at a location spaced from, and between, the upper end and lower ends, an upper bow string opening in said upper end and a lower bow string opening in said lower end, the sighting opening having a center aligned with the bow string openings along a first direction, a bow string-receiving slot extending from the upper bow string opening to the lower bow string opening, wherein the slot extends around the sighting opening on a first side thereof, wherein the slot has an opening to the exterior of the block along its entire length whereby a bow string can be introduced into the slot when the bow string is in a slack condition but still attached at both ends to a bow, wherein the slot has internal surfaces engageable by a bow string extending through the slot and in tension, said internal surfaces including a first surface, a second surface, and a third surface between said first and second surfaces with reference to the length of the slot, said first and second surfaces facing in directions opposite to the direction in which said third surface faces, whereby tension in the bow string causes the string to press against said surfaces, and engagement of the bow string with said surfaces when the bow string is in tension prevents disengagement of the block from the bow string.

2. A peepsight according to claim 1, wherein the first surface of the slot is in a first portion of the slot formed in the rear face of the block, said first portion extending from the upper end of the block to a first intermediate location between the upper and lower ends, the second surface of the slot is in a second portion of the slot also formed in the rear face of the block, said second portion extending from the lower end of the block to a second intermediate location between the upper and lower ends, the first and second portions are both connected, respectively at said first and second intermediate locations, to a third portion of the slot formed in the front face of the block, and said third surface is in said third portion of the slot.

3. A peepsight according to claim 2, in which the first and second portions of the slot are undercut whereby protruding parts of the block are disposed between parts of said first and second surfaces and the rear face of the block.

4. A peepsight according to claim 1, wherein a viewing slot extends from the sighting opening to an edge of the block on the side of the sighting opening opposite from said first side thereof.

* * * * *